United States Patent [19]

Finn et al.

[11] Patent Number: 4,601,942

[45] Date of Patent: Jul. 22, 1986

[54] LAMINATED SOFT FACED-SPIRAL WOVEN PAPERMAKERS FABRIC

[75] Inventors: William A. Finn, Summerville, S.C.; Harry I. Searfass, Wayne, Pa.

[73] Assignee: Asten Group Inc., Devon, Pa.

[21] Appl. No.: 752,935

[22] Filed: Jul. 8, 1985

Related U.S. Application Data

[63] Continuation of Ser. No. 639,959, Aug. 10, 1984, Pat. No. 4,528,236.

[51] Int. Cl.[4] ..... D03D 13/00

[52] U.S. Cl. ..... 428/222; 162/348; 428/226; 428/227; 428/229; 428/236; 428/280; 428/282; 428/284

[58] Field of Search ..... 428/222, 226, 227, 229, 428/236, 280, 282, 284; 162/348

[56] References Cited

U.S. PATENT DOCUMENTS

| | | | |
|---|---|---|---|
| 4,119,753 | 10/1978 | Smart | 428/234 |
| 4,186,566 | 2/1980 | AuYoung | 62/380 |
| 4,283,454 | 8/1981 | Buchanan | 428/233 |
| 4,381,612 | 5/1983 | Shank | 34/116 |
| 4,415,625 | 11/1983 | Borel | 428/222 |
| 4,446,189 | 5/1984 | Romanek | 428/152 |
| 4,481,079 | 11/1984 | Dawes | 162/348 |

*Primary Examiner*—Marion C. McCamish
*Attorney, Agent, or Firm*—Benasutti and Murray

[57] ABSTRACT

The present invention relates to a papermakers fabric having an upper layer comprised of a batt and an under layer comprised of a plurality of intermeshed monofilament spiral coils, retained by pintle means; the upper and lower layers being unified into a single fabric by application of adhesives to the interface between the batt layer and the under layer.

31 Claims, 5 Drawing Figures

LAMINATED SOFT FACED-SPIRAL WOVEN PAPERMAKERS FABRIC

This is a continuation of application Ser. No. 639,959, filed Aug. 10, 1984, U.S. Pat. No. 4,528,236.

BACKGROUND OF THE INVENTION

1. Field of the Invention

The disclosed fabric is intended for use in the papermaking industry and finds particular application in the wet press and dryer section of the papermaking equipment. The fabric is a carrying or conveying means used in the production of paper and is intended for use in applications requiring either a circular woven or a flat woven fabric. In the papermaking industry, fabrics of the instant invention, when used in the wet press or dryer section, are frequently referred to as felts since they generally comprise a carrier fabric, which runs in contact with the equipment, and a felt surface, which runs in contact with the paper.

2. Description of the Prior Art

It has been recognized in the prior art that it is desirable to provide a felt for use in papermaking machinery comprising an under layer made of relative rigid non-deformable material having a compressible felt layer thereon. The under layer is generally expected to provide a desired void volume for receiving and carrying off water removed from the paper sheet. For example, as the fabric with the paper sheet thereon passes between the nip rollers in the press section, the felt is compressed and water is transferred from the paper sheet to the felt. This water is intended to migrate through the felt and to be voided through the voids provided in the under layer.

The prior art, has recognized that a felted surface used in combination with an under layer having a predetermined and controlled void volume may be utilized to provide a felt having relatively fine fibers for contacting the sheet of paper to be processed. U.S. Pat. Nos. 3,613,258; 4,119,753; 4,283,454 and 4,356,225 are representative of prior art attempts to control void volume.

SUMMARY OF THE INVENTION

The present invention provides a papermakers felt having an under layer, comprised of a plurality of intermeshed preformed spiral strips, defining a void volume and a felt batt adhered thereto. The felt may be adhered to the under layer by the selective application of adhesive to the under layer and/or to the felt layer or may be adhered by including meltable adhesive fibers within the felt layer. The under layer and the felt layer are unified into a single fabric such as by application of heat and pressure sufficient to activate the adhesive and bond the layers together.

DESCRIPTION OF THE PREFERRED EMBODIMENT

Figure 1:
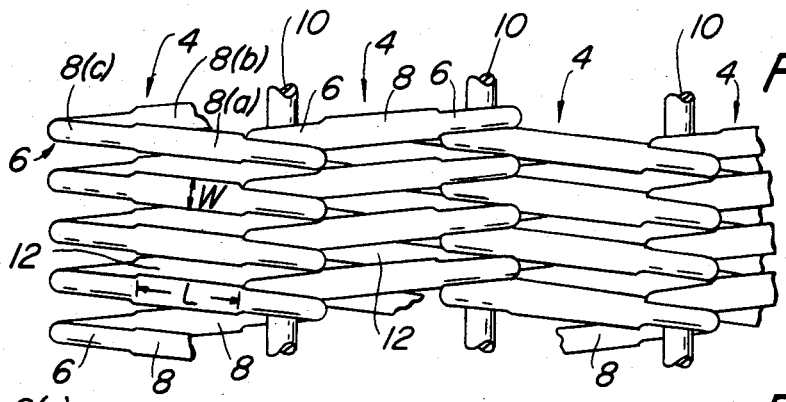
FIG. 1 is a top plan fragmentary view of an under layer of fabric showing a plurality of intermeshed spiral strips, each of the spirals having modified midsections.

With reference to FIG. 1, there is shown an under layer or base fabric generally referenced as 2. The under layer or base fabric 2 is comprised of a plurality of intermeshed spiral strips 4 which are retained in the intermeshed condition by a plurality of pintles 10. Each of the spiral strips 4 is a monofilament comprised of a plurality of spirals 6. Formation of spiral strips 4 will be discussed in more detail hereinafter. Each of the spirals 6 is comprised of an upper face 8(*a*), a lower face 8(*b*) and connecting links 8(*c*). In the embodiment shown in FIG. 1, upper face 8(*a*) and lower face 8(*b*) are modified and have a surface width greater than the connecting links 8(*c*). The modification of upper face 8(*a*) and lower face 8(*b*) result in a fabric having reduced void volume and/or permeability. Depending upon the degree of control desired, both the upper and lower face may be modified as shown in FIG. 1 or only a single face may be modified. If only a single face is to be modified, it is generally preferred to modify the upper face 8(*a*) as this is the portion of the fabric which will be closest to the paper supporting surface.

It will be appreciated that the monofilament of spiral strip 4 is rigid or incompressible and not easily deformed in the fabric.

With respect to formation of the spiral strips and the upper formation of upper and lower faces 8(*a*) and 8(*b*), which may be formed after the formation of the spiral strips, equipment for each of these purposes is available from EHVAK Maschinen GmbH, Niederroder Weg 10, 6056 Heusenstamm, West Germany.

In order to form the under layer or base fabric 2, the desired number of spiral strips 4 are positioned adjacent each other such that the link portion 8(*c*) of the spirals on one spiral strip are intermeshed with their counterparts on another spiral strip in order to form a pintle receiving passage. A pintle 10 is then inserted into the passage and retains the spiral strips 4 in the fabric construction. In general, the length of upper face 8(*a*) and lower face 8(*b*) will be controlled so as to permit the respective links 8(*c*) of the adjacent spiral strips to interlace without interference resulting from the modification of the monofilament. It will be appreciated that the permeability of the fabric in that portion where the links 8(*c*) are intermeshed and the pintle is located will generally be less than that for the remainder of the fabric. The degree of modification of the upper face and lower face will reflect considerations regarding the void volume and permeability in the intermeshed area of the fabric. As noted previously, in certain applications, it may be desirable to eliminate either one or both of the faces 8(*a*) and/or 8(*b*).

With reference to FIG. 1, it can be seen that an open mesh 12 is defined in the fabric between adjacent faces 8(*a*) and between the opposed links 8(*c*) of the respective spiral strips. As will be appreciated by those skilled in the art, a fabric having spiral strips with faces 8(*a*) and 8(*b*) will define similar open mesh areas on either face of the fabric. For those fabrics having only a single face 8(*a*) or 8(*b*) the open mesh 12 will be different on the respective faces of the fabric.

With reference to the permeability of the fabric, it will be appreciated by those skilled in the art that the desired permeability will vary with machine design and end use applications. However, it is estimated that the finished fabric will generally be between 40 CFM and 250 CFM for dryer fabric applications and between 10 CFM and 100 CFM for wet or press felt applications. Those skilled in the art will further understand that the batt 24, FIG. 4, will influence and contribute to the final permeability.

Figure 2:
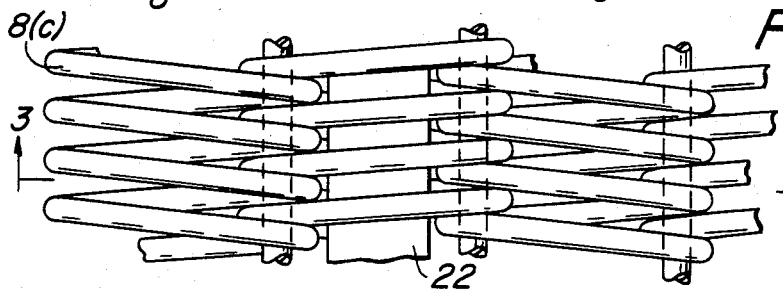
FIG. 2 is a top plan fragmentary view showing a plurality of intermeshed spiral strips, each of the spirals having a generally uniformed diameter throughout.

With reference to FIG. 2, there is shown a fabric 2 which is constructed in the same fashion as the fabric of FIG. 1. However, in the fabric of FIG. 2, the monofilament yarns do not have upper faces or lower faces such as 8(*a*) and 8(*b*) as shown in FIG. 1. Instead, each of the spirals 6 comprising the spiral strip 4 will be made up of monofilaments having a substantially uniformed diameter as represented by 8(*c*). It will be appreciated, that the void volume and permeability in the area of the intermeshed coils with pintle 10 will be lessened as in accordance with the description of FIG. 1. If modification of the void volume and/or permeability of a fabric constructed according to FIG. 2 is desired, it may be accomplished by the use of filler strands, generally indicated at 22. The use of such filler strands and the various techniques for varying the permeability by insertion of filler strands will be known to those skilled in the art and does not require further explanation herein. Filler strands 22 may be of special usefulness in fabrics produced with shaped monofilaments as spirals 6 for the reasons noted below.

It will further be understood by those skilled in the art that the spirals 6 may be formed from shaped monofilaments.

Figure 3:
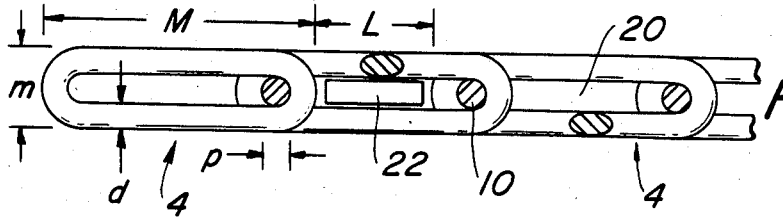
FIG. 3 is a section taken through the line 3—3 of FIG. 2 and depicts a side elevational view of the fabric of FIG. 2.

With reference to FIG. 3, there is illustrated a section view of the fabric according to FIG. 2. The spirals 6 have a major axis M and a minor axis m and a diameter d. FIG. 3 graphically depicts the intermeshing of the links 8(*c*) of adjacent spiral strips 4 and the location of the pintle 10. FIG. 3 clearly shows the reduced void volume or permeability of the intermeshed pintle area and likewise depicts the voids 20 which may be modified by means of filler strands 22 to control the void volume and/or permeability.

Further with reference to FIGS. 1, 2, and 3, it will be appreciated by those skilled in the art that the void volume and permeability of the fabric may be modified by various combinations of open mesh 12 and modified void volumes 20.

Figure 4:
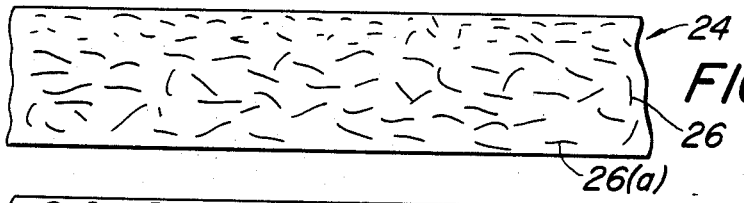
FIG. 4 is illustrative of a felt batt which may be used in accordance with the above identified invention.

With respect to FIG. 4, there is shown a felt batt 24. Batt 24, as will be known to those skilled in the art, may be made of different materials and various densities according to end product application. The batt 24 is generally firm and supports the paper being transported on the felt, however, batt 24 is more compressible than the under layer 2. The technique for forming the batt 24 will be known to those skilled in the art.

Figure 5:
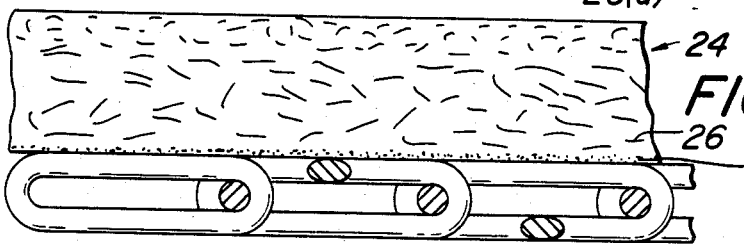
FIG. 5 is an illustrative drawing showing the completed fabric as produced by assembling the under layer of FIG. 3 with the felt of FIG. 4.

With respect to FIG. 5, there is illustrated a fabric, similar to that depicted in FIG. 2 with the batt, similar to that of FIG. 4 adhered thereto. In the embodiment depicted in FIG. 5, the batt 24 is adhered to the under layer or base fabric 2 by means of selective application of an adhesive layer 30 to the under layer or base fabric. The application of the adhesive 30 to under layer 2 may be made uniformly or by random application of the adhesive. Examples of adhesives suitable for application in the instant invention are Scotch Grip, an Epoxy available from 3M Company, Esthane, a urethane available from B. F. Goodrich and RTV Series Silicones, available from General Electric. As a result of adhesive layer 30, the under layer 2 and the batt 24 are maintained as an unitary fabric. It will be appreciated that the adhesive of layer 30 has been exagerated for the purpose of illustration. It is anticipated that the adhesive layer will not occupy a major volume of the final fabric.

It is further to be appreciated that the adhesive must be applied with such care as to prevent adhesion of the spirals 6 and/or the adhesion of spiral strips 4. To obtain the full advantages of the invention the under layer or base fabric 2 must retain its flex characteristics within the finished felt. Excessive adhesion of spiral strips 4 may lead to under desired running characteristics and performance qualities.

In an alternative method of adhering the layers, the joining layer 18 may be comprised of heat meltable or fusible fibers which are incorporated into the fibers of batt 24 at the time it is fabricated. The use of heat meltable or fusible fibers in the batt 24 is depicted in FIG. 4 as 26(*a*). Incorportion of the fibers 26(*a*) may be achieved by a technique known to those skilled in the art as stratification. Additionally, the adhesive layer 30 could comprise a sprayed adhesive or a fusible film or a laminated layer which is applied to the under layer fabric 2. Suitable films may be formed of fusible polyethylenes, polypropylenes, polyamids, polyesters, and urethanes. Furthermore, it will be appreciated by those skilled in the art that the extent to which adhesive layer 30 extends over the surface of the fabric will depend upon the adhesive selected and the required adhesion. As a further alternative, it is possible to adhere the fabrics by use of a resin treatment which is applied to the under layer fabric 2 to reduce its permeability. The use of a resin treatment to establish adhesion will be known to those skilled in the art.

With reference to FIGS. 1, 2 and 3, it will be appreciated that the diameter of the monofilament will affect the width of the faces 8, 8(*a*), and 8(*b*). Since it is desirable to have the links 8(*c*) in a touching or nearly touching relationship, the width, w, of the faces 8(*a*) and 8(*b*) is limited as a practical matter to twice the diameter, d, of the monofilament, thus w=2d. This condition when combined with the touching or near touching of the links 8(*c*) would, in effect, close off the space available between the individual spirals 6 and produce the maximum reduction in permeability. As the fabric is designed for greater permeability this relationship may be relaxed. With respect to the maximum length of the faces 8, 8(*a*), and 8(*b*), the length (L) may generally be expressed by the formula: maximum length (L) equals the major axis (M) minus twice the selected pintle diameter (p), plus four times the diameter of the monofilament (d) or $L=M-(2p+4d)$.

We claim:

1. An improved papermakers fabric of the type having synthetic monofilament yarns interconnected to define an under layer and a batt which defines an upper layer united in a single fabric by adhesive means, the improvement characterized by:

an under layer comprised of a plurality of intermeshed synthetic monofilament spiral strips which are retained in that relationship by pintle means.

2. The fabric of claim 1, further characterized by:

filler strands inserted in the spiral strips between adjacent pintles.

3. The fabric of claim 2, further characterized by:

each of said spiral strips containing a plurality of spirals, each of said spirals having a major axis and a minor axis.

4. The fabric of claim 3, further characterized by: face portions of at least a first surface of said spirals having a width greater than the diameter of the monofilament comprising the spiral strips.

5. The fabric of claim 4, further characterized by: said face portions having a width no greater than twice the diameter of the monofilament.

6. The fabric of claim 5, further characterized by: second face portions on a second surface of said spirals having a width greater than a diameter of the monofilament comprising the spiral strips.

7. The fabric of claim 6, further characterized by: said second face portions having a width no greater than twice the diameter of the monofilament.

8. The fabric of claim 7, further characterized by: said second face portions having a maximum length defined by the equation maximum length equals the major axis minus twice the diameter of the pintle means plus four times the diameter of the monofilament or $L=M-(2p+4d)$.

9. The fabric of claim 7, further characterized by: said first and second face portions having a maximum length defined by the equation maximum length equals the major axis minus twice the diameter of the pintle means plus four times the diameter of the monofilament or $L=M-(2p+4d)$.

10. The fabric of claim 4, further characterized by: said face portions having a maximum length defined by the equation maximum length equals the major axis minus twice the diameter of the pintle means plus four times the diameter of the monofilament of $L=M-(2p+4d)$.

11. The fabric of claim 10 further characterized by: said filler strands having a width less than the maximum length of said face portions.

12. The fabric of claim 10 further characterized by: said filler strands having a width less than the maximum length of said face portions but greater than twice the diameter of the monofilament.

13. The fabric of claim 1, further characterized by: each of said spiral strips containing a plurality of spirals, each of said spirals having a major axis and a minor axis.

14. The fabric of claim 13, further characterized by: face portions of at least a first surface of said spirals having a width greater than the diameter of the monofilament comprising the spiral strips.

15. The fabric of claim 14, further characterized by: said face portions having a width no greater than twice the diameter of the monofilament.

16. The fabric of claim 15, further characterized by: second face portions on a second surface of said spirals having a width greater than a diameter of the monofilament comprising the spiral strips.

17. The fabric of claim 16, further characterized by: said second face portions having a width no greater than twice the diameter of the monofilament.

18. The fabric of claim 17, further characterized by: said second face portions having a maximum length defined by the equation maximum length equals the major axis minus twice the diameter of the pintle means plus four times the diameter of the monofilament or $L=M-(2p+4d)$.

19. The fabric of claim 17, further characterized by: said first and second face portions having a maximum length defined by the equation maximum length equals the major axis minus twice the diameter of the pintle means plus four times the diameter of the monofilament or $L=M-(2p+4d)$.

20. The fabric of claim 19, further characterized by: filler strands inserted in the spiral strips between adjacent pintles.

21. The fabric of claim 20, further characterized by: said filler strands having a width less than the maximum length of said face portions.

22. The fabric of claim 20, further characterized by: said filler strands having a width less than the maximum length of said face portions but greater than twice the diameter of the monofilament.

23. The fabric of claim 14, further characterized by: said face portions having a maximum length defined by the equation maximum length equals the major axis minus twice the diameter of the pintle means plus four times the diameter of the monofilament of $L=M-(2p+4d)$.

24. An improved papermakers' fabric of the type having an under layer, defined by a plurality of synthetic monofilament yarns, and an upper layer, defined by a batt, which are united in a single fabric by adhesive means, the improvement characterized by:

each of said under layer synthetic monofilament yarns having a plurality of spirals which are intermeshed with spirals of adjacent yarns and interconnected by pintle means.

25. The fabric of claim 24, further characterized by: each of said spirals having a major axis and a minor axis.

26. The fabric of claim 25, further characterized by: face portions of at least a first surface of said spirals having a width greater than the diameter of the monofilament comprising the spiral strips.

27. The fabric of claim 26, further characterized by: said face portions having a width no greater than twice the diameter of the monofilament.

28. The fabric of claim 26, further characterized by: said face portions having a maximum length defined by the equation maximum length equals the major axis minus twice the diameter of the pintle means plus four times the diameter of the monofilament or $L=M-(2p+4d)$.

29. The fabric of claim 28, further characterized by: second face portions on a second surface of said spirals having a width greater than a diameter of the monofilament comprising the spiral strips.

30. The fabric of claim 29, further characterized by: said second face portions having a width no greater than twice the diameter of the monofilament.

31. The fabric of claim 30, further characterized by: said second face portions having a maximum length defined by the equation maximum length equals the major axis minus twice the diameter of the pintle means plus four times the diameter of the monofilament or $L=M-(2p+4d)$.

* * * * *